US005082010A

United States Patent [19]

Skaryd et al.

[11] Patent Number: 5,082,010

[45] Date of Patent: Jan. 21, 1992

[54] METHOD OF ELONGATING HAIR

[76] Inventors: Peter Skaryd; Norma Skaryd, both of Frankfurter Str. 184, D-6078 Neu-Isenburg, Fed. Rep. of Germany

[21] Appl. No.: 698,784

[22] Filed: May 13, 1991

[30] Foreign Application Priority Data

May 29, 1990 [DE] Fed. Rep. of Germany ..... 90110120

[51] Int. Cl.[5] ..... A41G 5/00

[52] U.S. Cl. ..... 132/201; 132/200

[58] Field of Search ..... 132/201, 200, 56, 53

[56] References Cited

U.S. PATENT DOCUMENTS

| | | | |
|---|---|---|---|
| 3,295,534 | 1/1967 | Dorkin | 132/201 |
| 3,833,007 | 9/1974 | Jacobs | 132/53 |
| 4,934,387 | 6/1990 | Megna | 132/201 |
| 4,982,748 | 1/1991 | Trimarchi | 132/201 |

*Primary Examiner*—John J. Wilson
*Assistant Examiner*—Jeffrey A. Smith
*Attorney, Agent, or Firm*—Beveridge, DeGrandi & Weilacher

[57] ABSTRACT

A method of elongating hair of a person having head-hair is described which involves, cleaning the head-hair thereby releasing head-hair to be elongated from oil, dividing a number of dry head-hairs which are to be elongated and approximately the same number of the elongating hair, so that two tufts of hair are formed each having a free end, twirling the tufts at their free ends to form two twirled tuft-ends, overlapping the two twirled tuft-ends by a predetermined distance, twirling together the overlapping tuft-ends and adhering the twirled overlapping tuft-ends at ambient temperature with an adhesive.

18 Claims, No Drawings

METHOD OF ELONGATING HAIR

BACKGROUND OF THE INVENTION

1. Field of the invention

The subject invention relates to a method of elongating hair. Elongating hair is well-known in the prior art and is used with people who need long hair very quickly or whose hair does not grow fast enough. This is especially the case with black people, because their hair grows so slowly that it would take 20–30 years until their hair has an acceptable length. However, the invention is not useful only for black people, but also for all other people who want to elongate their hair.

2. Description of Related Art

In the prior art elongating hair is done using a method called "weaving". In this method, the short hair of a woman or man is elongated by connecting their hair with threads to artificial or natural hair other than their own. However, "weaving" takes up lots of space and covers the scalp, making it difficult to be massaged, and prevents the pores from breathing. This causes the scalp to sweat and this is uncomfortable, especially in warm climates. Further, "weaving" does not make it possible for the hair to be thoroughly washed, and when the hair starts to grow from the scalp, it twirls, around the threads and the braids that hold the elongated hair (especially for black people). This area becomes more compact and does not allow water and particles from shampoo to run free. This causes breakage of natural hair. Additionally the threads swell if they become wet. The result is that when the hair and the threads become dry again, the threads become a bit looser each time. If this process is repeated several times the connection between the two parts of hair (the head-hair and the elongating hair) will weaken and the individual with the elongated hair will run the risk of losing the elongating hair. This is the reason why people whose hair has been elongated using the "weaving" method avoid needlessly wetting or combing their hair. Nevertheless, they must renew their hair-style every 2–3 months. This procedure takes approximately 8 hours and costs a great deal of money.

SUMMARY OF THE INVENTION

It is therefore an object of the invention to provide a cleaner and healthier and more comfortable and more practicable method of elongating hair.

It is another object of the invention to elongate hair in such a manner that this hair can become wet without the possibility of loosening the connection between the head-hair and the elongating hair.

It is another object of the invention to provide elongated hair which can be easily combed, without the fear of losing hair.

It is another object of the invention to provide elongated hair which lasts for a long time.

It is another object of the invention to provide a method which takes four to five hours at most.

According to the invention, these and other objects and advantages are achieved using a method of elongating hair by cleaning the hair, for example, with a surfactant thus releasing the head-hair from oil. Then, one divides, for example, 20–150 single dry head-hairs to be elongated and, for example, 20–150 single natural or artificial hairs to elongate the head-hairs, so that two tufts of hair are formed each having a free end. One then twirls the end of each of the two tufts of hair in such a manner that the two twirled tufts can overlap each other along a distance of about 3–10 mm. Finally, they are adhered at ambient temperature using an adhesive composition, which has a fixture time of about 10–60 seconds.

DETAILED DESCRIPTION OF THE INVENTION

The method of elongating hair can normally be carried out at a hairdresser's shop. However, it is also possible to carry out the method at home or elsewhere. At first it is necessary to wash the head-hair of the person whose head-hair is to be elongated. The head-hair can be washed with a surfactant, especially a "shampoo" available readily from numerous commercial sources. Finally, the head-hair must be free of oil and totally dry. If the person who wants to elongate his or her hair is a black person or has many small curls, his or her hair must preferably be free of curls. This can be effected with chemicals available in a hardresser's shop. Then, for example, a hairdresser or any other person divides a tuft of 20–150 head-hairs of the person whose head-hair is to be elongated and a tuft of 20–150 natural or artificial elongating hair other than their own which are dry and not oily. The hair used for the elongating process can be artificial or (preferably) natural hair. After forming the two tufts, an end of each of the two tufts is first separately twirled with two fingers on the two hands of the person carrying out the elongation, and finally, they are twirled together with one hand in such a way that they form a unit. Before they are twirled together, the ends of the tufts must overlap each other within a distance of 3–10 mm, preferably 5–7 mm. These two ends twirled together must be held between the two fingers of one hand of the person elongating the head-hair, and in the other hand, the person holds a tube containing an adhesive composition, which is preferably a cyanoacrylate adhesive composition. This adhesive is readily available from numerous commercial sources. From this tube, the person takes a drop and spreads this drop over the two ends of the tufts twirled together with the two fingers holding the two tufts together. It is necessary to hold the two tufts together for some time, preferably 10–15 seconds, because the adhesive has a fixture time of 10–60 seconds. The adhesion occurs at ambient temperature, so no warmth is needed to adhere the two tufts of hair. Once these two tufts are adhered, one forms the next two tufts and repeats the steps as described above until all the head-hair is elongated.

The cyanoacrylate adhesive compositions are prefered in this method because these adhesives are tolerated by human tissue. Cyanoacrylate adhesive compositions are used as wound-adhesives in surgery. These adhesives are reaction adhesives which involve polymerization reactions and they react very fast, so the method according the invention does not takes much time. For the start of the reaction only the humidity of the air and no warmth are needed, so this reaction can take place elsewhere.

Hair elongated using this method is not sensitive to wetness, so people who have elongated their hair according to the invention may swim and wet their hair in any way. They can wash it as often as they wish. This has no effect on the adhesive connection of their hair. They can also comb their hair as often as they wish, without losing the elongated hair. The adhesive connection can last as long as it is convenient to the person who has elongated his or her hair according to the invention.

We claim:

1. A method of elongating head-hair of a person with elongating hair, comprising: cleaning the head-hair to be elongated with cleaning means thereby releasing said head-hair to be elongated from oil; dividing a plurality of dry head-hairs which are to be elongated and dividing at least approximately the same plurality of an elongating hair, so that two tufts of hairs are formed each having a free end; twirling the tufts at their said free ends to form two twirled tuft-ends; overlapping the two twirled tuft-ends by a predetermined distance and twirling together the overlapping tuft-ends; and adhering the twirled overlapping tuft-ends at ambient temperature with an adhesive.

2. A method according to claim 1, wherein the elongating hair is natural hair.

3. A method according to claim 1, wherein the elongating hair is artificial hair.

4. A method according to claim 1, wherein the cleaning means is a surfactant.

5. A method according to claim 4, wherein the surfactant is a shampoo.

6. A method according to claim 1, wherein each of the tufts comprise 20–150 single hairs.

7. A method according to claim 1, wherein the predetermined distance of overlapping is 3–10 mm.

8. A method according to claim 1, wherein the adhesive is a cyanoacrylate composition hardening at ambient temperature.

9. A method according to claim 8, wherein the cyanoacrylate composition has a fixture time of 10–60 seconds.

10. A method of elongating hair of a person with elongating hair, comprising: cleaning the head-hair to be elongated with a surfactant thereby releasing the head-hair to be elongated from oil; dividing a plurality of dry head-hairs which are to be elongated and dividing approximately the same plurality of the elongating hair, so that two tufts of hair are formed each having a free end; twirling the tufts at their said free ends to form two twirled tuft-ends; overlapping the two twirled tuft-ends by a predetermined distance, and twirling together the overlapping tuft-ends; and adhering the twirled overlapping tuft-ends at ambient temperature with a cyanoacrylate adhesive composition.

11. A method according to claim 10, wherein the elongating hair is natural hair.

12. A method according to claim 10, wherein the elongating hair is artificial hair.

13. A method according to claim 10, wherein the surfactant is a shampoo.

14. A method according to claim 10, wherein each of the tufts comprises 20–150 single hairs.

15. A method according to claim 10, wherein the predetermined distance of overlapping is 3–10 mm.

16. A method according to claim 10, wherein the adhesive is a cyanoacrylate composition hardening at ambient temperature.

17. A method according to claim 15, wherein the cyanoacrylate composition has a fixture time of 10–60 seconds.

18. A method of elongating hair of a person with elongating hair, comprising: cleaning the head-hair to be elongated with a surfactant thereby releasing the head-hair to be elongated from oil; dividing 20–150 single dry head-hairs which are to be elongated and 20–150 single natural or artificial elongating hairs, so that two tufts of hair are formed each having a free end; twirling the tufts at their said free ends to form two twirled tuft ends; overlapping the two twirled tuft-ends by a distance of 3–10 mm and twirling together the overlapping tuft-ends; and adhering the two twirled tuft-ends at ambient temperature with a cyanoacrylate adhesive composition which has a fixture time of 10–60 seconds.

* * * * *